United States Patent [19]

Munding et al.

[11] 4,337,685

[45] Jul. 6, 1982

[54] APPARATUS FOR GENERATING A PROPELLANT GAS

[75] Inventors: German Munding, Bad Friedrichshall; Wolfgang Müller, Möckmühl; Heinrich Strobl, Munich, all of Fed. Rep. of Germany

[73] Assignee: Messerschmitt-Bölkow-Blohm Gesellschaft mit beschränkter Haftung, Munich, Fed. Rep. of Germany

[21] Appl. No.: 677,236

[22] Filed: Apr. 12, 1976

[30] Foreign Application Priority Data

Apr. 24, 1975 [DE] Fed. Rep. of Germany ..... 2518149

[51] Int. Cl.[3] ..... F41F 1/04

[52] U.S. Cl. ..... 89/7

[58] Field of Search ..... 89/7, 8

[56] References Cited

U.S. PATENT DOCUMENTS 2,965,000 12/1960 Skinner ..... 89/7

3,044,363 7/1962 Musser ..... 89/7 UX 3,763,739 10/1973 Tassie .

FOREIGN PATENT DOCUMENTS 399252 3/1966 Switzerland ..... 89/7

*Primary Examiner*—Stephen C. Bentley

*Attorney, Agent, or Firm*—Toren, McGeady & Stanger

[57] ABSTRACT

In an apparatus for generating a propellant gas, such as is used in propelling projectiles, at least one rotation chamber acts as a propellant gas generator containing a ring-shaped flow of propellant. A closed circuit is connected to the chamber for circulating a liquid propellant to it. Either monergolic or hypergolic propellants can be used with the rotation chamber being formed of at least two sub-chambers when hypergolic propellants are used. The two sub-chambers are connected by an overflow weir. The closed circuit which is provided for each of the chambers involved in the generation of the propellant gas, includes a valve for regulating the quantity of propellant disposed in a ring-shaped flow within the chamber. The valve regulates the amount of propellant required for the gas-generating operation. Further, the closed circuit includes an arrangement for sealing flow into and out of the rotation chamber or chambers during the generation of the propellant gas so that a rapid pressure buildup can be attained.

14 Claims, 3 Drawing Figures

APPARATUS FOR GENERATING A PROPELLANT GAS

SUMMARY OF THE INVENTION

The present invention concerns an apparatus for generating a propellant gas such as is used in propelling projectiles, and, more particularly, it is directed to a propellant gas generator formed as a rotation chamber into which at least one liquid propellant is injected tangentially.

In the field of weaponry it is known to propel cartridge-less projectiles by means of liquid propellants. In U.S. Pat. No. 3,138,990 a liquid propellant machine gun is disclosed which includes a differential pressure piston-combustion chamber system for generating pressure gases for propelling a projectile from the barrel of a firearm or weapon. In such a system two hypergolic propellants are directed into the combustion chamber where they react with one another and generate the propellant gas.

In this prior art construction, the initiation of the generation of the propellant gas takes place at the forward reversing point of the differential pressure piston and a partial amount of the two hypergolic propellants is first conveyed with the aid of supply pressure into the forward region of the combustion chamber. As a result, with the reaction of the propellants, a compressed combustion pressure is built up which bears against the forward annular end of the differential pressure piston and displaces the piston rearwardly after overcoming the counterforce which moved the piston to its forward position. Subsequently, this counterforce returns the pressure piston back into its forward reversing position. In this arrangement, annular spaces are provided which act as propellant distribution chambers. In these annular spaces where the propellants are stored, the propellants are placed under pressure by ring collars on the differential pressure piston and are injected into the combustion chamber. Automatically operating check valves are provided in the supply lines of the propellants and cut off flow from the supply. Since the annular end face directed into the combustion chamber is larger than the end faces of the ring collars which pressurize the stored amounts of propellant, a differential action takes place with the injection pressure in any one instance being larger than the corresponding inner pressure of the combustion chamber.

To obtain favorable ballistic conditions it is, according to the "Law of Ballistics," required that the amount of gunpowder which is charged into a projectile cartridge be sufficient that, upon ignition, the pressure gases generated for propelling the projectile from a barrel reach a large initial pressure to provide the projectile with a high initial acceleration and thus with a high muzzle velocity. In this regard, known weapons which operate with a differential pressure-combustion chamber for the generation of the propellant gases, there is the decided disadvantage that the initial phase of propellant gas generation takes place when the differential pressure piston is in its forward reversing position. The injection pressure energy results merely from the relatively low propellant supply vessel pressure and, in turn, a relatively flat rise of the pressure curve in the "path-pressure" diagram or of the ballistic working diagram takes place.

It is noted that such known weapons as described above also have certain advantages, such as savings in the use of cartridges, weight reduction and reduced sensitivity of the propellants used.

The pressure peak which is decisive for a large initial acceleration of the projectile is reached only after a delay with a resultant time loss in the form of an undesired dwell time. Accordingly, the pressure peak is reached only after a predetermined combustion chamber pressure is developed which results in an increase in the amount of propellant injected. To summarize, it can be stated that in weapons operating with a differential pressure piston, the formation of a favorable "path-pressure" diagram and the injection of the propellants causes great difficulty due to the manner in which the combustion chamber pressure reaches its highest values, disregarding the fact that the structural elements forming the pressure chamber, which are moved relative to one another with relatively great masses, result in considerable wear.

Therefore, it is a primary object of the present invention to provide a propellant gas generator, particularly for use in weaponry, of the type described above, which is simple in conception and construction and affords a particularly favorable course of the required generation of the propellant gas pressure within the combustion chamber. Further, another object of the invention is to reduce the wear and tear on such propellant gas generators and thus to increase their useful life.

In accordance with the present invention, the problems previously experienced are overcome by providing a closed propellant circuit for each of the single or multiple combustion chambers used in which the propellant gas is generated. The one or more propellants are directed into the chamber to provide a rotating fuel ring. Blocking elements are located at the inlet into and at the outlet from the chamber which operate during the generation of the propellant gas to block any flow into or out of the chamber. After the generation of the propellant gas and its use, the pressure within the chamber drops off and the blocking elements again permit flow into and out of the chamber. Preferably, the blocking elements operate automatically. To reduce the number of machine parts utilized in the present propellant gas generator, the present invention provides so-called fluid-diodes as hydraulically operating, automatically functioning blocking elements which are automatically operated by the changing chamber pressure during propellant gas generation.

In the apparatus embodying the present invention, during the propellant gas generation operation with the pressure in the chamber increasing and as soon as that pressure exceeds the pressure at which the propellant is supplied, the inlet and outlet into the rotation chamber is sealed from the exterior for a period which lasts until the completion of the operation with which the propellant gas is associated, such as the propulsion of a projectile or the development of a pulse. In other words, the chamber remains sealed until its interior pressure drops below that in the propellant supplying circuits. When the chamber pressure drops below the propellant supply pressure, the propellant is again directed tangentially into the chamber until the rotating propellant ring has reached the desired radial thickness. The propellant volume developed in the chamber forms the "charge" of the chamber. In accordance with the invention, the charge may be varied in accordance with the amount of propellant gas required. In this manner, and in a preferred application of the invention for weaponry, larger or smaller "reaches" or penetration effects (muzzle velocity) can be obtained.

However, it should be appreciated that the invention is not limited to weaponry but, as already indicated, can also be used, for example, in pulsating rebound propulsion units.

To provide a more rapid ignition or combustion in the case of reaction or hypergolic propellants or a more rapid decomposition in the case of monergolic propellants, of the amount of the propellant or charge which is rotating within the chamber, it is further proposed to combine the main chamber with a sub-chamber. In a practical arrangement such combinations can be afforded by locating the sub-chamber in a coaxial manner with the main chamber so that, as compared to the inner diameter of the propellant ring in the main chamber, the sub-chamber has somewhat larger diameter and flow into the main chamber is throttled. A "thin" propellant ring is present in the sub-chamber and is in communication with the propellant ring in the main chamber. Such "thin" ring can be ignited by a suitable device, either electrically or chemically. The ignited gases from the sub-chamber flow into the main chamber and there very quickly ignite or decompose the charge amount.

In accordance with the present invention, ignition is generally facilitated and promoted within the rotating propellant ring as a gaseous propellant core develops due to evaporation and gasification, which core is always ready for ignition. This characteristic is, moreover, facilitated by the phenomenon that due to the centrifuging action of the rotating propellant, the consistency of the propellant changes radially from the radially outer portion to the radially inner portion, from a pure liquid consistency, via a mixed phase into a gaseous condition. Such a rotating core facilitates the speed of combustion.

In one embodiment of the invention, where several and, particularly, two hypergolically reacting propellants are used, a separate chamber or sub-chamber is provided for each of the propellants and an overflow weir interconnects the two chambers each of which has its own closed propellant supply circuit. By providing an insignificant increase in one or both of the rings of propellant flowing in the chambers, contact of the hypergolic fuels can be achieved for commencing the generation of the propellant gas. The change in the amount of propellant can be regulated, in accordance with the invention, by increasing the inlet amount or decreasing the outlet amount of one or both of the hypergolic propellants.

In a weapon, the propellant gas generation chamber can be located coaxially with the barrel, however, the chamber can also be arranged laterally adjacent the barrel. Further, a sub-chamber can be locally separated from the main propellant gas chamber and connected to it by an overflow channel. Due to the provision of a closed propellant circuit for each chamber and the continuous presence of a rotating propellant ring in the chamber as the propellant charge, there is a constant operational preparedness assured in the present propellant gas apparatus, since the chamber is constantly charged. Moreover, the chamber is constantly cooled due to the manner in which the propellant flows within the chamber and this is particularly important where there are repeated or long-lasting propellant gas generation operations. Due to the constant presence of a rotating ring of propellant at the inner surface of the chamber, a defined propellant surface is maintained constantly which is independent of the positions of the weapon. The pressure required for supplying the propellant can be maintained at the low level, since only the subsequent filling of the chamber has to be accomplished. No movable parts subject to wear are required except for the pump or pumps which supply the propellant and the pump drive has to operate only under relatively insignificant stresses or loads.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
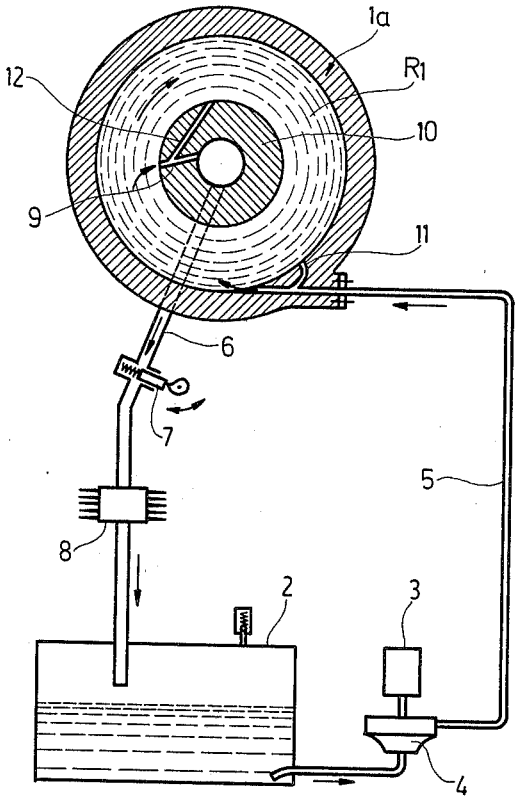
FIG. 1 is a schematic illustration of an apparatus embodying the present invention and illustrating a propellant gas generating chamber.

In FIG. 1, a propellant gas-generating chamber 1*a* is illustrated. A liquid propellant supply vessel 2 is connected to the chamber 1*a* over a supply line 5. A feed pump 4 is positioned in the supply line 5 and driven by a motor 3 for feeding the propellant into the chamber 1*a*. A discharge line 6 is connected at one end to the chamber 1*a* and at its opposite end to the vessel 2. The discharge or outlet line 6 contains a quantity control valve 7 and a cooler 8. The amount of propellant charged into the chamber 1*a* can be regulated by the valve 7.

The supply line 5 opens tangentially into the combustion chamber which is configured so that a stable rotational flow is provided in the form of a propellant ring R1 whose radial thickness or strength is determined by the location of one or more outlets 9. The outlets 9 are located in a central wall member 10 spaced radially inwardly from the wall forming the chamber 1*a* and the wall member 10 does not have to extend for the full axial dimension of the chamber 1*a*. Instead of the outlet 9 located in the central wall member 10, it is possible to provide a known radially adjustable scooping tube.

The amount of the propellant rotating in the ring R1 constitutes the charge of the propellant gas producing chamber 1*a* and is ignited in a known manner. After the ignition of the charge, the pressure of the propellant gases in the chamber increases due to the provision of hydraulically operated automatically functioning fluid-diodes located at the propellant inlet and outlet of the chamber 1*a*. These fluid diodes can effect a blocking action on the flow of the propellant into and out of the chamber 1*a*.

The fluid-diodes are provided by a counter-pressure line 11 located in the wall of the chamber and another counter-pressure line 12 located at the outlet 9 from the chamber which is positioned in the central wall member 10. The counter-pressure line 11 is connected to the interior of the chamber at a position spaced from the inlet and is connected into the supply line 5 so that flow through the line 11 is directed into the line 5 in the same flow direction as the inflowing propellant. The other counter-pressure line 12 has a first end opening to the interior space of the chamber 1*a* and a second end connected to the outlet 9 so that the flow from the chamber through the line 12 is directed into the outlet 9 in the direction opposite to the direction of flow of the propellant through the outlet. At the entrance of the counter-pressure line 11 into the supply line 5 and of the counter-pressure line 12 into the outlet 9 a hydraulic pressure blocking occurs when the pressure within the chamber rises above the pressure of the inflowing propellant causing a hydraulic pressure blocking within the inlet and outlet to the chamber. Accordingly, while the propellant gas pressure remains higher than the feed pressure of the propellant into the chamber, the chamber is sealed off at its inlet and outlet. As soon as the pressure within the chamber drops below the feed pressure of the propellant, the introduction into the chamber of the propellant is recommenced in the form of a rotating ring.

Figure 2:
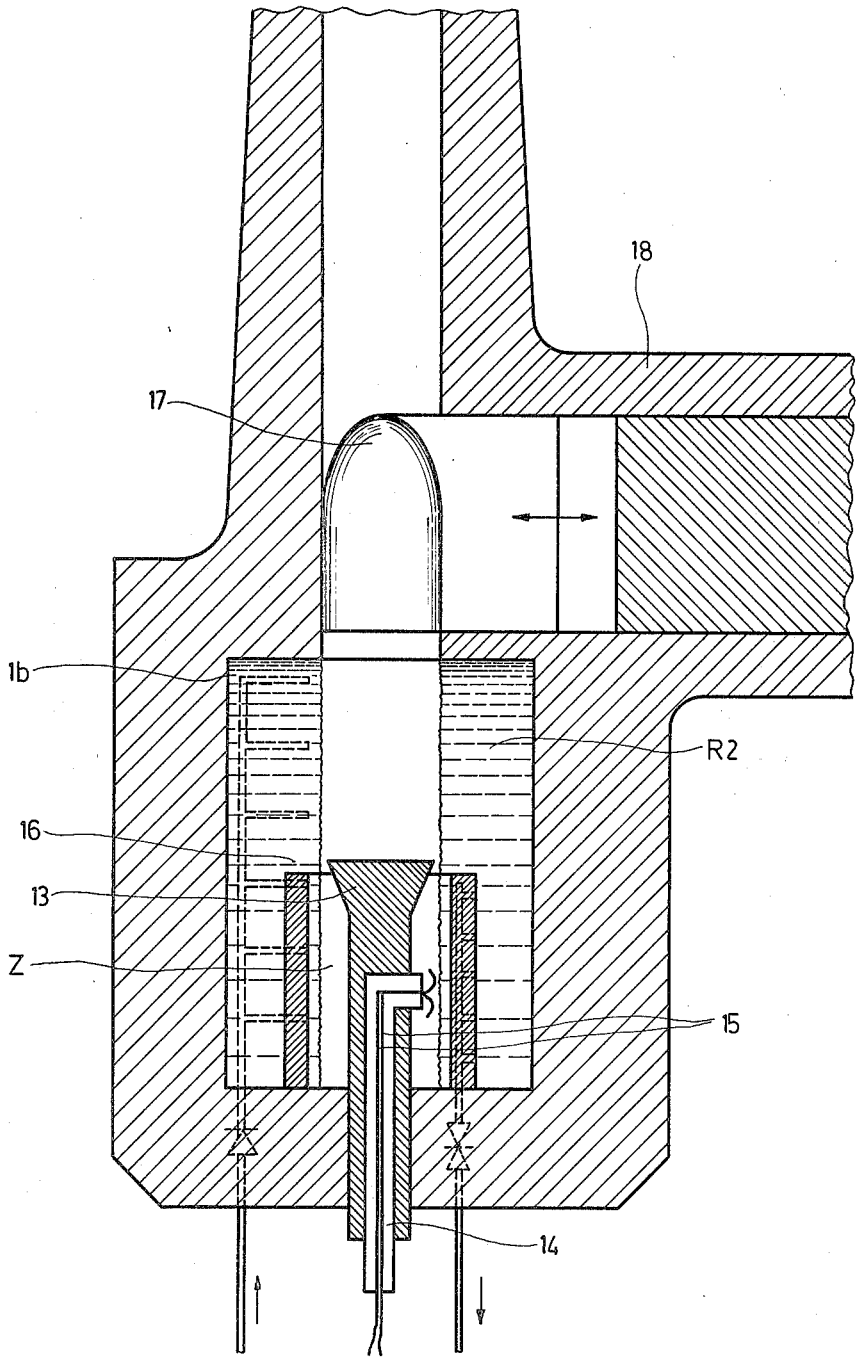
FIG. 2 is a partial cross-sectional view of a propellant gas generating chamber supplied with monergolic propellants and forming a part of a weapon.

In FIG. 2 an ante-chamber or sub-chamber Z is arranged ahead of the main chamber 1*b* for the generation of propellant gases. The sub-chamber Z forms an ignition chamber for the propellant gases. The diameter of the sub-chamber Z is somewhat larger than the inner diameter of the rotating propellant R2. As a result, a small amount of the propellant will always be stored in the sub-chamber Z. A frusto-conically shaped or mushroom shaped throttle member 13 separates the interior of the sub-chamber Z from the interior of the main chamber 1*b*. An insulator 14 is provided within the sub-chamber Z with an ignition electrode 15 located within the insulator. The electrode 15 provides the ignition for the small amount of propellant located in the sub-chamber Z. The gases ignited within the sub-chamber flow through the throttle gap provided by the throttle member 13 located in the opening from the sub-chamber Z into the main chamber 1*b* for causing the ignition of the total amount of propellant within the main chamber. The propellant gases generated in the main chamber 1*b* provide a propelling charge acting on the base of the projectile 17 for driving it from the barrel of the weapon. The projectile 17 is positioned within the barrel being supplied through a charging shaft 18 extending laterally from the base of the barrel.

Figure 3:
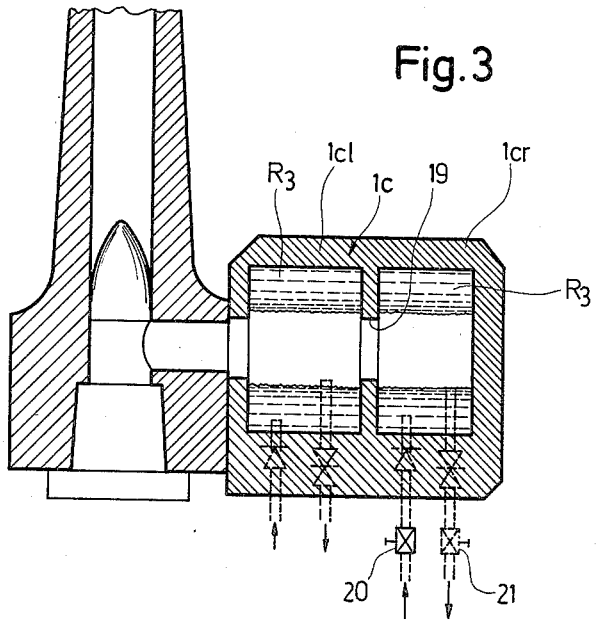
FIG. 3 is a cross-sectional schematic showing of a propellant gas-generating chamber arrangement for a weapon in which two hypergolic propellants are utilized.

In FIG. 3 a double chamber 1*c* is connected to the base of a weapon, extending laterally from it, and, as viewed in FIG. 3, the double chamber is divided into a lefthand sub-chamber 1*cl* and a righthand sub-chamber 1*cr*. A suitable propellant is supplied into one of the sub-chambers and oxygen or an oxygen carrier is supplied into the other sub-chamber. Both propellants react hypergolically with one another. The lefthand and righthand sub-chambers 1*cl*, 1*cr* are separated from one another by an overflow weir 19 located at the level of the rotating propellant rings within the sub-chambers. To provide the contact of the hypergolic propellants for initiating ignition, it is merely necessary to temporarily open or close one of the valves 20,21 which are provided one in the supply line and the other in the outlet line of one of the fuel circuits associated with the sub-chambers, so that one of the two propellants flows over the weir into the other sub-chamber for commencing the ignition of the hypergolic propellants. It should be noted that each of the sub-chambers has its own closed circuit so that each of the propellant components can be supplied for flowing in a ring shaped path within its sub-chamber. Ordinarily, the two propellant components flowing in the sub-chambers 1*cl*, 1*cr* do not contact one another, however, by regulating the flow into or out of one of the sub-chambers so that the quantity of propellant component is increased, it is possible to effect the interaction of the hypergolic fuels.

While specific embodiments of the invention have been shown and described in detail to illustrate the application of the inventive principles, it will be understood that the invention may be embodied otherwise without departing from such principles.

What is claimed is:

1. An apparatus for generating propellant gas such as used in propelling projectiles, comprising wall means defining at least one rotation chamber which forms a propellant gas generator and means for feeding at least one liquid propellant tangentially into said chamber, wherein the improvement comprises that said feeding means include a closed liquid propellant circuit connected to said rotation chamber for flowing propellant into and removing it from said rotation chamber, said feeding means includes an inlet into and an outlet from said rotation chamber for generating a rotating ring of propellant in said rotation chamber, and blocking means in operative association with each of said inlet and said outlet for blocking flow of the propellant therethrough into and out of said rotation chamber during the period commencing with the increase of the pressure propellant within the rotation chamber at the outset of the generation of the propellant gas and terminating at the decrease of the pressure of the propellant after the completion of the generation and utilization of the propellant gas.

2. An apparatus, as set forth in claim 1, wherein said blocking means operate automatically.

3. An apparatus, as set forth in claim 1, wherein said blocking means operate hydraulically in the form of fluid diodes.

4. An apparatus, as set forth in claim 3, wherein said inlet extends through said wall means and opens into said chamber, said closed circuit includes a vessel containing the liquid propellant and a supply line connecting the vessel and said inlet, and said blocking means comprises a counter-pressure passage having a first end and a second end with said first end opening into said rotation chamber at a position spaced from the opening of said inlet into said rotation chamber and said second end opening into said supply line in the direction of flow of the liquid propellant through said supply line into said inlet.

5. An apparatus, as set forth in claim 3, wherein said outlet extends through said wall means and opens into said chamber, said closed circuit includes a vessel containing the liquid propellant and a discharge line connecting the liquid propellant and said outlet, and said blocking means comprises a counter-pressure passage formed in said wall means having a first end and a second end with said first end opening into said rotation chamber and said second end opening into said discharge line in the direction opposite to the flow of propellant through said outlet and discharge line to said vessel.

6. An apparatus, as set forth in claim 1, wherein said wall means comprises an outer annular wall and an inner wall spaced radially inwardly from said outer wall and defining the rotating ring of propellant and said inner wall containing said outlet and in combination with said outer wall defining the radial dimension of the ring of propellant.

7. An apparatus, as set forth in claim 5, wherein a regulable quantity control valve is located in said discharge line between said outlet and said vessel.

8. An apparatus, as set forth in claim 1, wherein said wall means also form a sub-chamber disposed in communication with said rotation chamber, said sub-chamber arranged to receive an amount of the propellant, and ignition means associated with said sub-chamber for igniting the propellant so that the ignited propellant enters into said rotation chamber and ignites the total propellant gas content of said rotation chamber.

9. An apparatus, as set forth in claim 8, wherein said sub-chamber is arranged coaxially with said rotation chamber with said sub-chamber opening directly into the rotating ring of propellant in said rotation chamber, and a throttling member positioned within said sub-chamber in the path of propellant between said rotation chamber and said sub-chamber.

10. An apparatus, as set forth in claim 9, wherein said rotating ring of propellant having an inner diameter and an outer diameter and said sub-chamber having an inside diameter larger than the inner diameter and smaller than the outer diameter of said rotating ring of said propellant.

11. An apparatus, as set forth in claim 1, wherein said rotation chamber comprises a first sub-chamber and a second sub-chamber, said feeding means forming a separate closed propellant circuit for each of said first and second sub-chambers with each sub-chamber arranged to contain a separate hypergolic propellant flowing in a rotating ring, said wall means forming an overflow weir interconnecting said first and second sub-chambers so that, by increasing the amount of at least one of the hypergolic propellants, flow over said weir can be achieved for effecting reacting contact between the hypergolic propellants.

12. An apparatus, as set forth in claim 11, wherein a regulable control valve is located in at least one of said closed circuits of said sub-chambers for increasing the amount of the hypergolic propellant flowing in said valved closed circuit for effecting the overflow and reacting contact of the hypergolic propellants.

13. An apparatus, as set forth in claim 12, wherein said closed circuit includes a propellant storage vessel, an outlet line connecting said sub-chamber and said propellant storage vessel, and at least one cooler located in said outlet line between said sub-chamber and said vessel.

14. An apparatus, as set forth in claim 7, wherein at least one cooler is located in said discharge line between said outlet and said vessel.

* * * * *